US011480990B2

(12) United States Patent
Zhou et al.

(10) Patent No.: US 11,480,990 B2
(45) Date of Patent: Oct. 25, 2022

(54) PRESSING MECHANISM

(71) Applicant: Hangzhou Amphenol Phoenix Telecom Parts Co., Ltd., Zhejiang (CN)

(72) Inventors: Yuanyue Zhou, Zhejiang (CN); Kyoung-Hong Son, Zhejiang (CN)

(73) Assignee: HANGZHOU AMPHENOL PHOENIX TELECOM PARTS CO., LTD., Zhejiang (CN)

( * ) Notice: Subject to any disclaimer, the term of this patent is extended or adjusted under 35 U.S.C. 154(b) by 0 days.

(21) Appl. No.: 17/430,591

(22) PCT Filed: Feb. 17, 2020

(86) PCT No.: PCT/CN2020/075466
§ 371 (c)(1),
(2) Date: Aug. 12, 2021

(87) PCT Pub. No.: WO2020/168990
PCT Pub. Date: Aug. 27, 2020

(65) Prior Publication Data

US 2022/0129030 A1 Apr. 28, 2022

(30) Foreign Application Priority Data

Feb. 18, 2019 (CN) ..... 201920212132.9

(51) Int. Cl.
*G05G 1/02* (2006.01)
*G05G 5/05* (2006.01)

(52) U.S. Cl.
CPC ..... *G05G 1/02* (2013.01); *G05G 5/05* (2013.01)

(58) Field of Classification Search
CPC ..... H01H 3/12; H01H 3/122; H01H 3/125; G05G 1/02; G05G 1/025
See application file for complete search history.

(56) References Cited

U.S. PATENT DOCUMENTS 5,850,194 A * 12/1998 Lin ..... H01H 3/125 200/344
6,300,583 B1 * 10/2001 Hsu ..... H01H 3/125 200/344

(Continued)

FOREIGN PATENT DOCUMENTS

CN 102789917 A 11/2012
CN 202633072 U 12/2012

(Continued)

*Primary Examiner* — Richard W Ridley
*Assistant Examiner* — Brian J McGovern
(74) *Attorney, Agent, or Firm* — Muncy, Geissler, Olds & Lowe P.C.

(57) ABSTRACT

The present invention discloses a pressing mechanism, comprising a pressing member, a support, a pressing member supporting spring, and a first sliding member and a second sliding member which synchronously slide in opposite directions, the first sliding member being provided with first inclined grooves, the second sliding member being provided with second inclined grooves, the first and second inclined grooves being oppositely inclined and inclined with respect to the lifting direction of the pressing member, and the first and second inclined grooves being provided in pairs; the first and second inclined grooves are provided on both sides, corresponding to the pressing member, of the first and second sliding members, and are respectively formed in pairs, the pressing member is movably connected to the first inclined grooves and the second inclined grooves by means of movable connection shafts, each movable connection shaft penetrating through the paired first and second inclined grooves, and the support is provided with lifting guide grooves for the connection shaft. The structure of the present invention is simple, reliable and easy to assemble. Whichever side of the pressing member is pressed, the pressing member is not inclined, ensuring that the pressing member moves vertically downward and is reset under the driving of (Continued)

the spring, and can control and drive the motion output of the two sliding members under the action of the inclined grooves of the sliding members.

4 Claims, 2 Drawing Sheets

(56) References Cited

U.S. PATENT DOCUMENTS

| | | | | |
|---|---|---|---|---|
| 10,509,482 | B1 * | 12/2019 | Tsai | G06F 3/0202 |
| 11,152,168 | B1 * | 10/2021 | Wu | H01H 3/122 |
| 11,177,083 | B1 * | 11/2021 | Wu | H01H 3/122 |
| 2001/0002647 | A1 * | 6/2001 | Hayashi | H01H 3/125<br>200/344 |
| 2005/0217983 | A1 * | 10/2005 | Hsu | H01H 3/125<br>200/5 A |
| 2007/0028753 | A1 * | 2/2007 | Hsu | G10H 1/346<br>84/745 |
| 2013/0319838 | A1 * | 12/2013 | Zhang | H01H 13/705<br>200/520 |
| 2020/0294737 | A1 * | 9/2020 | Huang | H01H 13/84 |

FOREIGN PATENT DOCUMENTS

| | | | |
|---|---|---|---|
| CN | 103151204 | A | 6/2013 |
| CN | 103765540 | A | 4/2014 |
| CN | 103871766 | A | 6/2014 |
| CN | 207009321 | U | 2/2016 |
| CN | 105679589 | A | 6/2016 |
| CN | 109243893 | A | 1/2019 |
| JP | 2001229764 | A | 8/2001 |
| WO | WO-2009084115 | A1 | 7/2009 |

* cited by examiner

PRESSING MECHANISM

TECHNICAL FIELD

The present invention relates to a pressing mechanism, particularly to a pressing mechanism applied to plugs and sockets for locking and unlocking.

BACKGROUND

In the conventional pressing mechanisms, if a pressing plate or a button is wider or longer and the pressing point is not in the central position when pressing them, the pressing plate or button will incline, which will affect the appearance and operating feel.

SUMMARY

The technical problem to be solved by the present invention is to provide a pressing mechanism that is not inclined during the pressing process. To achieve the object, the present invention adopts the following technical solutions.

A pressing mechanism, comprising a pressing member, a support, and a pressing member supporting spring, wherein the pressing mechanism is further provided with a first sliding member and a second sliding member which synchronously slide in opposite directions, the first sliding member being provided with first inclined grooves, the second sliding member being provided with second inclined grooves, the first and second inclined grooves being oppositely inclined and inclined with respect to the lifting direction of the pressing member, and the first inclined grooves and the second inclined grooves being provided in pairs; the first inclined grooves and second inclined grooves are provided on both sides, corresponding to the pressing member, of the first sliding member and the second sliding member, and are respectively formed in pairs, the pressing member is movably connected to the first inclined grooves and the second inclined grooves by means of movable connection shafts, each movable connection shaft penetrating through the paired first inclined grooves and second inclined grooves, and the support is provided with lifting guide grooves for the connection shaft.

Further, the first sliding member and the second sliding member are arranged in the support, and a guiding engagement is formed between the first sliding member and the second sliding member, between the first sliding member and the support, between the second sliding member and the support.

Further, the support is in a groove-shaped configuration, the first sliding member and the second sliding member are both in an L-shaped configuration, the first sliding member and the second sliding member are arranged in the support, the lifting guide groove is arranged on the groove walls on both sides of the groove-shaped configuration, and the vertical walls of the L-shaped configuration of the first sliding member and the second sliding member abut against the groove walls on different sides respectively and the first inclined grooves and the second inclined grooves are arranged respectively; the bottom wall of the L-shaped configuration of the first sliding member and the second sliding member slidingly engages with the groove bottom of the groove-shaped configuration, and is slidingly restricted to the bottom of the groove through a connection member, the inner edges of the bottom wall of the L-shaped configuration of the first sliding member and the second sliding member form a mutual guiding engagement.

Further, a reservation area is formed between the bottom walls of the L-shaped configuration of the first sliding member and the second sliding member for a spring to penetrate, and the spring is supported on the groove bottom of the groove-shaped configuration.

Due to adoption of the technical solutions herein, the structure of the present invention is simple, reliable and easy to assemble. Whichever side of the pressing member is pressed, the pressing member is not inclined, ensuring that the pressing member moves vertically downward and is reset under the driving of the spring, and can control and drive the motion output of the two sliding members under the action of the inclined grooves of the sliding members.

DETAILED DESCRIPTION

Figure 1:
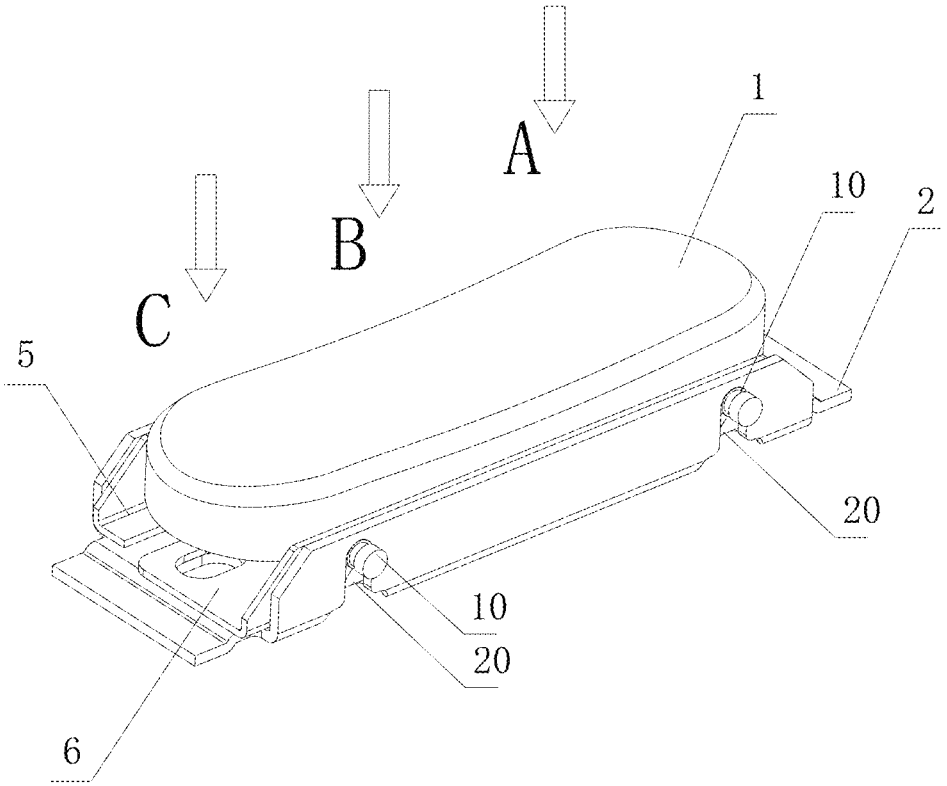
FIG. 1 is a schematic view of an embodiment provided by the present invention.

Referring to attached figures, the present invention provides a pressing mechanism, comprising a pressing member 1, a support 2, and a pressing member supporting spring 3. The pressing member can be a button or a pressing plate. For the present invention, even if a longer shape is used, when pressing, no matter on which side of the pressing member (any side of A, B and C in FIG. 1), it will not lift up on one side.

The pressing mechanism is further provided with a first sliding member 5 and a second sliding member 6 which synchronously slide in opposite directions, the first sliding member 5 being provided with first inclined grooves 51, the second sliding member 6 being provided with second inclined grooves 61, the first inclined grooves 51 and the second inclined grooves 61 being oppositely inclined and inclined with respect to the lifting direction of the pressing member 1, and the first inclined grooves 51 and the second inclined grooves 61 being provided in pairs; the first inclined grooves 51 and second inclined grooves 61 are provided on both sides, corresponding to the pressing member, of the first sliding member 5 and the second sliding member 6, and are respectively formed in pairs, the pressing member 1 is movably connected to the first inclined grooves 51 and the second inclined grooves 61 by means of movable connection shafts 10, each movable connection shaft 10 penetrating through the paired first inclined grooves 51 and second inclined grooves 61, and the support 2 is provided with lifting guide grooves 20 for the movable connection shaft 10. In the process of pressing downward or lifting the pressing member 1 driven by a spring, the movable connection shaft 10 is driven up and down along the lifting guide groove 20 by the pressing member 1, and the first inclined grooves 51 and the second inclined grooves 61 generate component forces to drive the first sliding member 5 and the second sliding member 6 to slide left and right.

Figure 2:
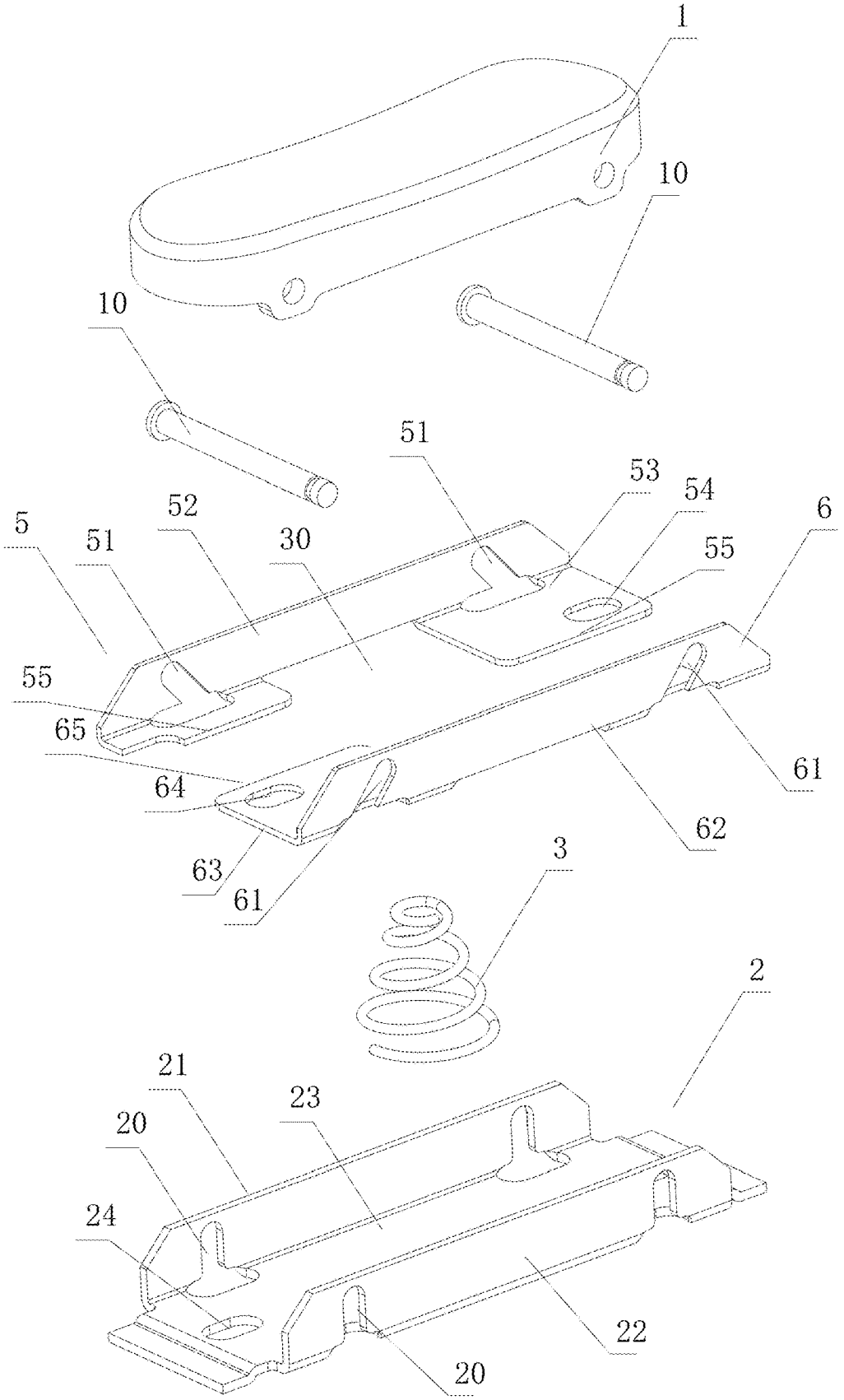
FIG. 2 is an exploded view of an embodiment provided by the present invention.

The support 2 is in a groove-shaped configuration, the first sliding member 5 and the second sliding member 6 are both in an L-shaped configuration, the first sliding member 5 and the second sliding member 6 are arranged in the support 2, the lifting guide groove 20 is arranged on the groove walls 21, 22 on both sides of the groove-shaped configuration, and the vertical walls 52, 62 of the L-shaped configuration of the first sliding member 5 and the second sliding member 6 abut against the groove walls 21, 22 on different sides respectively and the first inclined grooves 51 and the second inclined grooves 61 are arranged respectively; the bottom walls 53, 63 of the L-shaped configuration of the first sliding member 5 and the second sliding member 6 slidingly engage with the groove bottom 23 of the groove-shaped configuration, and is slidingly restricted to the bottom of the groove through a connection member. The reference numerals 54 and 64 are the long holes respectively engaged with the connection member. While connected, they can also engage with the connection member to form a limit of the sliding stroke. There is a corresponding hole 24 on the groove bottom 23 (FIG. 2 only shows a hole 24 on one side, and the hole on the other side is blocked). The inner edges 55, 65 of the bottom walls of the L-shaped configuration of the first sliding member 5 and the second sliding member 6 form a mutual guiding engagement. As a result, an overall sliding engagement relationship is formed, so that the operation is stable and the structure is simple.

The spring 3 is supported on the groove bottom 23 of the groove-shaped configuration. A reservation area 30 is formed between the bottom walls 53, 63 of the L-shaped configuration of the first sliding member and the second sliding member for the spring 3 to penetrate.

The above description is only specific embodiments of the present invention, but the structural features of the present invention are not limited thereto. Any changes or modifications made by those skilled in the art shall fall within the scope of protection of the present invention.

The invention claimed is:

1. A pressing mechanism, comprising a pressing member, a support, and a pressing member supporting spring, wherein the pressing mechanism is further provided with a first sliding member and a second sliding member which synchronously slide in opposite directions, the first sliding member being provided with first inclined grooves, the second sliding member being provided with second inclined grooves, the first and second inclined grooves being oppositely inclined and inclined with respect to the lifting direction of the pressing member, and the first inclined grooves and the second inclined grooves being provided in pairs; the first inclined grooves and second inclined grooves are provided on opposed sides, corresponding to the pressing member, of the first sliding member and the second sliding member, and are respectively formed in pairs, the pressing member is movably connected to the first inclined grooves and the second inclined grooves by movable connection shafts, each movable connection shaft penetrating through a paired one of the first inclined grooves and one of the second inclined grooves, and the support is provided with lifting guide grooves for the connection shafts.

2. The pressing mechanism according to claim 1, wherein the first sliding member and the second sliding member are arranged in the support, and a guiding engagement is formed between the first sliding member and the second sliding member, between the first sliding member and the support, between the second sliding member and the support.

3. The pressing mechanism according to claim 1, wherein the support is in a groove-shaped configuration, the first sliding member and the second sliding member are both in an L-shaped configuration, the first sliding member and the second sliding member are arranged in the support, the lifting guide grooves are arranged on groove walls on opposed sides of the groove-shaped configuration, and vertical walls of the L-shaped configuration of the first sliding member and the second sliding member abut against the groove walls on different sides respectively and the first inclined grooves and the second inclined grooves are arranged respectively; the bottom wall of the L-shaped configuration of the first sliding member and the second sliding member slidingly engages with the groove bottom of the groove-shaped configuration, and is slidingly restricted to the bottom of the groove through a connection member, the inner edges of the bottom wall of the L-shaped configuration of the first sliding member and the second sliding member form a mutual guiding engagement.

4. The pressing mechanism according to claim 3, wherein a reservation area is formed between the bottom walls of the L-shaped configuration of the first sliding member and the second sliding member for a spring to penetrate, and the spring is supported on the groove bottom of the groove-shaped configuration.

* * * * *